United States Patent [19]

Drummond

[11] 4,367,844

[45] Jan. 11, 1983

[54] MAILBOX

[76] Inventor: Donald J. Drummond, A6351 - 143rd Ave., Holland, Mich. 49423

[21] Appl. No.: 178,181

[22] Filed: Aug. 14, 1980

[51] Int. Cl.[3] ..... B65D 91/00

[52] U.S. Cl. ..... 232/17; 232/38; 232/39; 232/35

[58] Field of Search ..... 232/17, 35, 38, 39, 232/45; 248/146, 219.2

[56] References Cited

U.S. PATENT DOCUMENTS

| | | | |
|---|---|---|---|
| D. 129,901 | 10/1941 | Hanson et al. . | |
| D. 196,467 | 10/1963 | Alley . | |
| 1,065,078 | 6/1913 | Phipps | 232/45 |
| 1,232,616 | 7/1917 | Shinn . | |
| 1,994,186 | 3/1935 | Anderson | 232/39 |
| 2,025,251 | 12/1935 | Steinbronn . | |
| 2,148,465 | 2/1939 | Hein | 232/45 X |
| 3,156,418 | 11/1964 | Jablonski et al. | 248/219.2 X |
| 3,163,356 | 12/1964 | Joehnk | 232/17 X |
| 3,391,861 | 7/1968 | Seckler | 232/35 |
| 3,567,112 | 3/1971 | Wittekind | 232/45 X |
| 4,120,446 | 10/1978 | Fuemmeler | 232/17 |
| 4,146,171 | 3/1979 | Hodge | 232/39 X |
| 4,205,778 | 6/1980 | File | 232/35 |
| 4,247,039 | 1/1981 | Cornwell, Jr. | 232/35 |

*Primary Examiner*—Roy D. Frazier
*Assistant Examiner*—Peter A. Aschenbrenner
*Attorney, Agent, or Firm*—Price, Heneveld, Huizenga & Cooper

[57] ABSTRACT

A mailbox comprises a hollow, closed body having an open end with a door pivotally mounted therein. A rigid mounting sleeve, formed integrally and in one piece with the body, depends from the base of the mailbox and is shaped to telescopingly receive a support post therein to securely mount the mailbox and its contents at a desired location. The door preferably has a recessed handle and a recessed signal flag pivotally mounted in the exterior face of the door.

17 Claims, 5 Drawing Figures

MAILBOX

BACKGROUND OF THE INVENTION

The present invention relates to receptacles for mail, papers, periodicals, and the like, and in particular to a rural mailbox with an integrally formed mounting sleeve.

Mailboxes for use in rural-free delivery zones typically include means for supporting the mailbox on a post or other standard at a location adjacent a road. Heretofore, such mailboxes have been constructed of several formed sheet metal panels which are interconnected by fasteners to form a dome-shaped receptacle. Rural mailboxes are continuously exposed to the environmental elements and are prone to rust or oxidize. The mailboxes therefore require periodic maintenance, particularly for the moving parts of the box, such as the door and the signal flag. Also, the mounts which connect the mailbox to the support post, as well as the fasteners which interconnect the various wall panels of the mailbox, tend to corrode very quickly, thereby ruining the structural integrity of the box and sometimes allowing moisture to seep into the interior of the receptacle. As a result of this corrosion, standard mailboxes may require quite frequent painting and repair and also may have a relatively short effective life. This results in the need for periodic replacement.

Another problem experienced with present mailbox designs is that the exterior of the boxes include several sharp protrusions and/or edges which present a serious safety hazard to both users and other passersby. This safety hazard is exacerbated as the moving parts of the box rust and become difficult to manipulate. The configuration of the boxes may present a hazard for errant bicyclers, joggers and other pedestrians. Several sharp edges can typically be found at the door handle and/or latch on the top of the mailbox, the signal flag and mounting bracket therefor and around the bottom edge or apron of the mailbox which surrounds the base of the box.

Yet another disadvantage experienced with present mailboxes is that multipanel construction presents a very unattractive appearance and is inherently prone to water leakage, especially after the fasteners and wall panels have begun to corrode.

SUMMARY OF THE INVENTION

One aspect of the present invention is to provide a mailbox comprising a hollow, closed body having an open end through which mail and the like is inserted and withdrawn and a door for selectively closing the opening. A rigid mounting sleeve extends from one wall of the mailbox body and is formed integrally and in one piece therewith. The mounting sleeve defines an aperture shaped to telescopingly receive a mailbox support post therein and connect the box therewith to securely support the mailbox and its contents at a selected location above the ground. Preferably, the mailbox body and sleeve are molded as a single part from a synthetic resin or plastic material which is impervious to corrosion, and the door includes a molded handle and a recessed signal flag for improved safety, ease of use and enhanced appearance.

Another aspect of the present invention is to provide a mailbox having a door with a signal flag pivotally mounted and recessed into the exterior of the door. The door includes a molded channel into which the signal flag is received to store the same flush with the front of the door. Preferably, a concave recess is molded into the door adjacent the free end of the flag to facilitate grasping the same, and a molded, recessed handle is provided to facilitate opening and closing of the door.

The present invention provides a mailbox with an integrally formed rigid mounting sleeve telescopically receiving a mailbox support post therein to easily and securely mount the mailbox thereon to prevent sagging in any direction. The mailbox is quite durable and substantially impervious to corrosion. This eliminates upkeep and provides a long operating life. The mailbox body is preferably molded in one piece, so as to form a very secured, weathertight structure. The mailbox body also has rounded corners to facilitate manufacture, to present a very sleek, appealing appearance and to minimize safety hazards.

These and other features and advantages of the present invention will be further understood and appreciated by those skilled in the art by reference to the following written specification, claims and appended drawings.

DETAILED DESCRIPTION OF THE PREFERRED EMBODIMENTS

Figure 1:
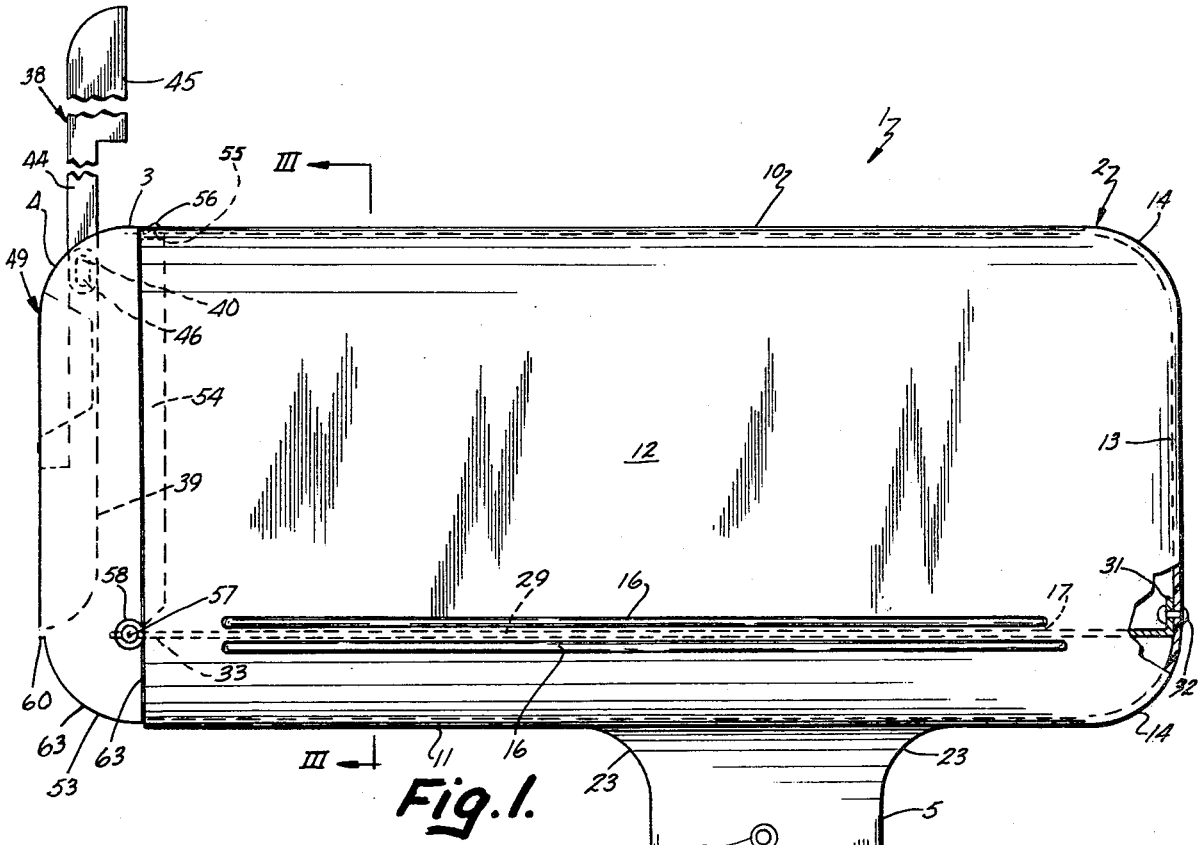
FIG. 1 is a side elevational view of a mailbox embodying the present invention with a signal flag portion thereof shown in fragmentary and in a raised position and a body portion broken away to reveal internal construction.
Figure 2:
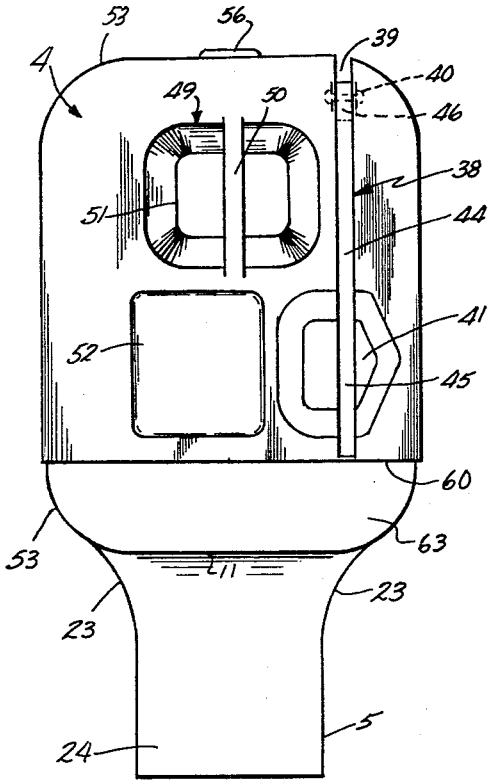
FIG. 2 is a front elevational view of the mailbox with the signal flag shown in a lowered position.

For purposes of description herein, the terms "upper", "lower", "right", "left", "rear", "front", "vertical", "horizontal" and derivatives thereof shall relate to the invention as oriented in FIGS. 1 and 2. However, it is to be understood that the invention may assume various alternative orientations, except where expressly specified to the contrary.

Figure 4:
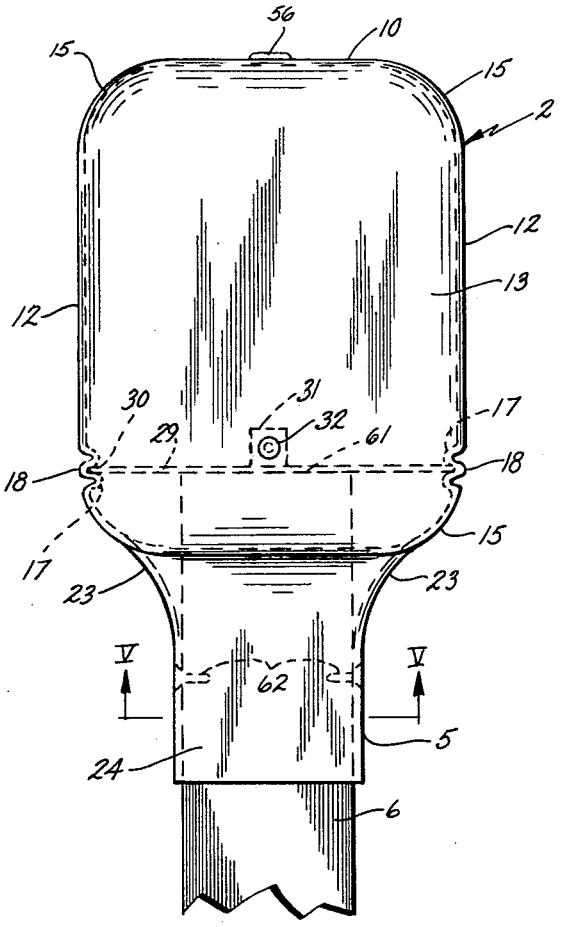
FIG. 4 is a rear elevational view of the mailbox shown connected to a support post.
Figure 5:
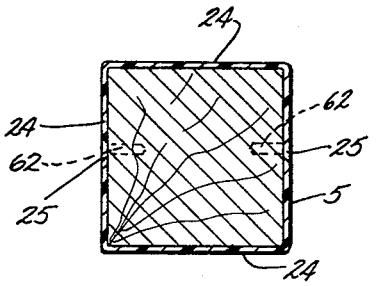
FIG. 5 is a horizontal cross-sectional view of the mailbox and post taken along the line V—V of FIG. 4.

The reference numeral 1 (FIG. 1) generally designates a mailbox embodying the present invention comprising a hollow, closed body 2 having an open end 3 with a door 4 pivotally mounted therein. A rigid mounting sleeve 5 is formed integrally and in one piece with body 2 and depends from the base of the mailbox to telescopingly receive a support post 6 (FIG. 4) therein.

Figure 3:
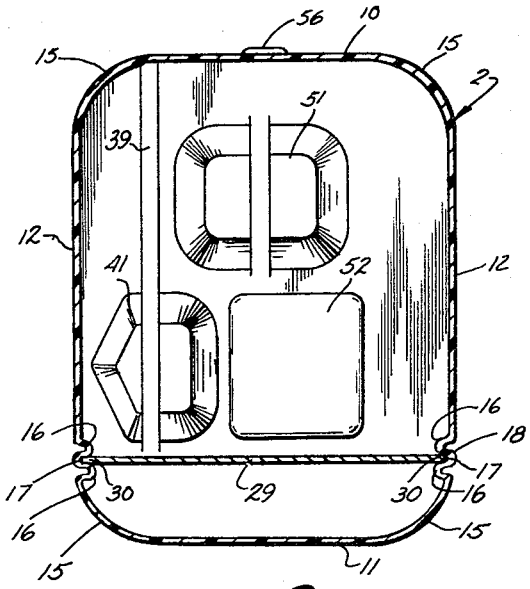
FIG. 3 is a vertical cross-sectional view of the mailbox taken along the line III—III of FIG. 1.

As best illustrated in FIGS. 1 and 3, mailbox body 2 is generally rectangular in shape, having top, bottom, and sidewalls 10, 11 and 12, respectively. The open end 3 of the mailbox body is disposed at the forward end of the mailbox, and the rearward end is closed by a wall 13 to form a hollow receptacle into which mail, packages, periodicals and the like are received. The corners and edges 14 and 15 of the mailbox body are rounded to facilitate manufacture and present a sleek, streamlined appearance. The body is preferably molded in one piece from a suitable corrosion and impact resistant material. One such material is high density polyethylene (HDPE). When using HDPE, it is preferred that the body 2 have a nomical wall thickness of 3/32 inch. A pair of inwardly oriented ribs 16 are provided in each body sidewall 12 and form a pair of channels 17 disposed in a horizontally aligned fashion for purposes to be described in greater detail hereinafter. As best illustrated in FIG. 3, the illustrated ribs 16 are formed by molding a corrugation 18 in the body sidewalls 12.

In this example, mounting sleeve 5 depends perpendicularly from the bottom wall 11 of mailbox body 2. However, it is to be understood that the present invention contemplates placement of the mounting sleeve 5 on any wall appropriate to a particular mounting arrangement. Sleeve 5 has a length sufficient to securely attach post 6 thereto and prevent lateral movement or rocking, and in this example, is in the nature of 3 to 5 inches long. As viewed in FIG. 2, sleeve 5 is laterally centered on the mailbox body, and as viewed in FIG. 1, it is positioned slightly rearwardly of the vertical centerline of the receptacle. The upper ends 23 of the mounting sleeve curve arcuately and outwardly into the body bottom wall 11 and are formed integrally therewith, such that the aperture defined between the walls of mounting sleeve 5 communicates with the interior of the mailbox body 12. Mounting sleeve 5 preferably has a noncircular lateral cross-sectional shape to prevent rotation of the mailbox on the post. In this example, a square shape is defined by sidewalls 24. Means are provided for connecting sleeve 5 with post 6 to retain the same together. In this example, countersunk apertures 25 are disposed through two sleeve walls 24 on the sides of the sleeve to facilitate fastening the mailbox to support post 6, as more thoroughly discussed below. It is to be understood that the present invention also contemplates other types of connecting means, including adhesive, nails, clips and even the weight of the mailbox body itself.

A base plate 29 (FIGS. 1 and 3) is mounted in the interior of the mailbox to form an elevated surface on which the contents of the mailbox, such as mail and the like, are supported. In this example, base plate 29 comprises a flat, rectangularly-shaped panel of sheet metal having opposing side edges 30 thereof received and retained in the channels 17 of body sidewalls 12, thereby supporting the base plate a spaced apart distance above the body bottom wall. In this manner, the mail is kept well separated from any moisture which might be present in the mailbox. The sides of base plate 29 are positioned in sidewall channels 17, and the base is slid rearwardly from the open body end 3 to rear wall 13. The rearward end of base plate 29 includes an upstanding flange 31 with a rivet 32 or other suitable fastener therethrough to connect the base plate with the rear body end wall 13. The forward end 33 of base plate 29 extends slightly beyond the open end 3 of the body 2.

As best illustrated in FIGS. 1 and 2, door 4 has a signal flag 38 pivotally attached thereto to indicate the presence of mail in the box. Door 4 includes a channel 39 in the exterior surface thereof in which signal flag 38 is pivotally mounted by a hinge pin 40. Channel 39 is shaped to receive the signal flag therein and store the same flush in door 4. A concave aperture or recess 41 is provided adjacent the free end of signal flag 38 to facilitate grasping the signal flag and pivoting the same outwardly from channel 39 into the raised position, as shown in FIG. 1.

Signal flag 39 includes an arm 44 and an enlarged display portion or flag 45 attached to the free end thereof. The lower end of arm 44 includes an elongated slot 46 in which hinge pin 40 is disposed. The elongated slot and channel arrangement provide a means for locking the flag in the upright position.

Door 4 also includes a recessed handle 49 (FIG. 2) to facilitate opening and closing the door. The outwardlymost protruding portion of handle 49 is a center bar 50 which is flush with the exterior surface of the door. A substantially rectangularly-shaped recess 51 forms a pocket in which the user's hands can be inserted to wrap it around the bar 50 and grasp the same. The front surface of door 4 includes another shallow recess 52 which is adapted to receive a label therein, such as that with indicia to indicate the name and address of the person whose mail is to be received in the mailbox. The corners 53 of door 4 are rounded in a manner similar to the mailbox corners and edges 14 and 15 and include an inwardly projecting rain lip 54 which underlaps the open end 3 of the mailbox body 2 about the top and sides thereof to form a secure seal therebetween. A protrusion or rib 55 is provided in the upper surface of lip 54 and engagingly cooperates with a mating rib 56 in the body top wall 10 to form a snap-lock or latch which securely retains the door in a closed position. Door 4 is pivotally attached to the mailbox body 2 by a pin 57 which is connected with the outer end of base plate 29 and extends laterally across the lower surface of the base. The ends of pin 57 extend through the sidewall of the door, and fasteners 58, such as snap nuts, are positioned over each pin end to prevent lateral door movement. A lower portion 63 of door 4 is inset slightly from the exterior face thereof along a horizontally ledge 60. The door is preferably constructed of a molded synthetic material which is either the same as, or compatible with, the molded synthetic material of the mailbox body. Hinge pin 57 is positioned a space apart distance upwardly from the bottom of the door, such that when the door is rotated outwardly to a position approximately 90° from the body open end 3, the lower end of the door engages the bottom surface of base plate 29 and thereby retains the door in a fully open position.

In use, support post 6 is anchored in the ground at the desired position. The mailbox 1 is then lowered over the support post 6, with mounting sleeve 5 telescopingly receiving the upper end of the post therein. The mailbox is lowered onto the post until the upper surface 61 of support post 6 abuts the lower surface of base plate 29. Fasteners 62 are then inserted through the associated sleeve apertures 25 to securely attach the mailbox to the post 6 and retain the same at a preselected distance above the ground. The abutment of the upper end of support post 6 with the lower surface of base plate 29 serves to support the base plate and add rigidity thereto for supporting heavy loads, such as packages and the like. Because base plate 29 remains rigid, the side edges of base 29 remain securely locked in the corresponding sidewall channels 17.

To open the mailbox door 4, the user simply inserts his hand under grasping bar 50 in recess 51, grips the bar and pulls the same forwardly. This force overcomes the snap-lock 55 and permits the door to be rotated outwardly 90°. At this position, the lower portion 63 of the door engages the bottom of base plate 29 and prevents further rotation. The door is closed by simply reversing the above steps.

To raise the signal flag, the user simply positions his hands about opposing sides of the signal flags in recess 41, grasps the flag between his fingers and pulls the same upwardly into an upright position. Since the signal flag is mounted in the door, it is readily accessed from the front of the mailbox and is convenient to manipulate. Also, the sides of the mailbox body are totally unobstructed for clear identification, decoration or the like. Outwardly directed force is applied to the flag arm during rotation so that the pin is disposed at the lowermost end of the arm 44. When the flag reaches the fully upright or vertical position, it is moved slightly downwardly in the channel 39 so that the pin abuts the inner end of the slot 46, thereby locking the flag in place. The signal flag is unlocked by raising the flag slightly and then pivoting it downwardly back into channel 39.

The molded mailbox and mounting sleeve provide a structure which is easily attached to a support post and is very strong and rigid. The recessed signal flag and handle arrangement, in conjunction with the rounded body corners, impart a very sleek, attractive appearance to the mailbox and also significantly reduce the safety hazards associated with its operation and use.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A mailbox, comprising:

a hollow, closed molded body having an open end through which mail and the like is inserted and withdrawn from said body, said body further including a top wall, a bottom wall and side walls, and closing means secured to said body for selectively closing and sealing said open end; and a rigid mounting sleeve extending perpendicularly from one of said walls of said body and being formed integrally and in one piece with said body, said mounting sleeve defining an aperture shaped to telescopically receive a mailbox support post therein and further including means for connecting said sleeve to the post to securely support said mailbox and its contents at a selected location above the ground, said body having smooth rounded edges and corners and said mounting sleeve having a noncircular lateral cross-sectional shape for preventing rotation of said mailbox on said support post, said body and said sleeve are molded as a single part from a synthetic resin material, and wherein:

said mounting sleeve depends from and opens through said bottom wall of said body at a substantially perpendicular relationship thereto.

2. A mailbox as set forth in claim 1, wherein:

said closing means comprises a door pivotally mounted in said body along a lower edge thereof; and a signal flag pivotally mounted and recessed into the exterior of said door, said door including a molded channel in the exterior face thereof shaped to receive said signal flag therein and store the same flush in said door.

3. A mailbox as set forth in claim 2, wherein:

said door includes a recessed handle.

4. A mailbox as set forth in claim 3, wherein:

said door includes a snap-lock at an upper edge thereof for securely retaining said door in a closed position.

5. A mailbox as set forth in claim 4, wherein:

said door is of a one-piece, molded construction.

6. A mailbox, comprising:

a hollow, closed body having an open end through which mail and the like is inserted and withdrawn from said body, and closed means for selectively closing said open end;

a rigid mounting sleeve extending from one wall of said body and being formed integrally and in one piece with said body, said mounting sleeve defining an aperture shaped to telescopically receive a mailbox support post therein and further including means for connecting said sleeve to the post to securely support said mailbox and its contents at a selected location above the ground, said closing means comprising a door pivotally mounted in said body along a lower edge thereof; and a signal flag pivotally mounted and recessed into the exterior of said door, said door including a recessed handle, said door including a snap-lock at an upper edge thereof for securely retaining said door in a closed position, said door being of a one-piece, molded construction, and wherein:

said door includes a molded channel in the exterior face thereof shaped to receive said signal flag therein and store the same flush in said door.

7. A mailbox as set forth in claim 6, wherein:

said door includes a molded recess adjacent the free end of said signal flag to facilitate grasping the same and pivoting said signal flag outwardly from said recess.

8. A mailbox, comprising:

a hollow, closed body having an open end through which mail and the like is inserted and withdrawn from said body, and means for selectively closing said open end;

a rigid mounting sleeve extending from one wall of said body and being formed integrally and in one piece with said body, said mounting sleeve defining an aperture shaped to telescopically receive a mailbox support post therein and further including means for connecting said sleeve to the post to securely support said mailbox and its contents at a selected location above the ground; and a base adapted to abuttingly support mail and the like thereon, said base being supported in the interior of said mailbox body at a spaced apart distance from the bottom surface thereof to keep the mail dry, and wherein:

said closing means comprises a door pivotally mounted on the outer end of said base at a position spaced upwardly from the bottom edge of said door, whereby when said door is pivoted outwardly, said door bottom edge abuts said base and retains said door in a fully open position.

9. A mailbox, comprising:

a hollow, closed body having an open end through which mail and the like is inserted and withdrawn from said body, and means for selectively closing said open end;

a rigid mounting sleeve extending from one wall of said body and being formed integrally and in one piece with said body, said mounting sleeve defining an aperture shaped to telescopically receive a mailbox support post therein and further including means for connecting said sleeve to the post to securely support said mailbox and its contents at a selected location above the ground; and a base adapted to abuttingly support mail and the like thereon, said base being supported in the interior of said mailbox body at a spaced apart distance from the bottom surface thereof to keep the mail dry, and wherein:

said body includes a pair of sidewalls, each with a pair of spaced apart, inwardly protruding ribs between which the side edges of said base are slidingly received and supported.

10. A mailbox as set forth in claim 9, wherein:

said ribs are formed by molded corrugations in said body sidewalls.

11. A mailbox, comprising:

a hollow, closed molded body having an open end through which mail and the like is inserted and withdrawn from said body, said body further including a top wall, a bottom wall and side walls, and closing means secured to said body for selectively closing and sealing said open end;

a rigid mounting sleeve extending perpendicularly from one of said walls of said body and being formed integrally and in one piece with said body, said mounting sleeve defining an aperture shaped to telescopically receive a mailbox support post therein and further including means for connecting said sleeve to the post to securely support said mailbox and its contents at a selected location above the ground, said body having smooth rounded edges and corners and said mounting sleeve having a noncircular lateral cross-sectional shape for preventing rotation of said mailbox on said support post; and a generally flat base adapted to abuttingly support mail and the like thereon, said body defining means for supporting said base in the interior of said mailbox body at a spaced apart distance from the bottom surface thereof and in a generally horizontal plane to keep the mail dry, said base includes a rearward end edge with a fastener connecting the same with a rearward wall of said body to retain said base in place, and wherein:

said base is supported in said body along opposing side edges of said base, said means for supporting said base including said body sidewalls defining elongated channels dimensioned to receive said opposing side edges of said base.

12. A mailbox as set forth in claim 11, wherein:

said mounting sleeve depends from a lower surface of said body at a substantially perpendicular relationship thereto.

13. A mailbox as set forth in claim 17, wherein:

said mounting sleeve is open ended and communicates with the interior of said body, whereby the upper end of the mailbox support post extends through said mounting sleeve to a position abutting a medial portion of said base and supports the same.

14. A mailbox as set forth in claim 13, wherein:

said sleeve includes at least one laterally extending aperture therethrough shaped to receive a fastener for connecting said mailbox with the support post and define said connecting means.

15. A mailbox, comprising:

a hollow, closed body having an open end through which mail and the like is inserted and withdrawn from said body, and a door for selectively closing said body open end; and a signal flag pivotally mounted and recessed into the exteior of said door, said door including a molded channel in the exterior face thereof shaped to receive said signal flag therein and store the same flush in said door.

16. A mailbox as set forth in claim 15, wherein:

said door includes a molded recess adjacent the free end of said signal flag to facilitate grasping the same and pivoting said signal flag outwardly from said recess.

17. A mailbox as set forth in claim 16, wherein:

said door includes a molded, recessed handle to facilitate opening and closing said door.

* * * * *

UNITED STATES PATENT AND TRADEMARK OFFICE

CERTIFICATE OF CORRECTION

PATENT NO. : 4,367,844

DATED : January 11, 1983

INVENTOR(S) : Donald J. Drummond

It is certified that error appears in the above-identified patent and that said Letters Patent is hereby corrected as shown below:

On the title page,

/54/ "MAILBOX" should be --MAILBOX HAVING AN INTEGRAL, DEPENDING MOUNTING SLEEVE--;

Col. 6, line 6:

"closed" should be --closing--;

Col. 8, line 12:

"17" should be --12--; and

Col. 8, line 29:

"exteior" should be --exterior--.

Signed and Sealed this

*Fourteenth* Day of *June 1983*

[SEAL]

*Attest:*

DONALD J. QUIGG

*Attesting Officer*

*Acting Commissioner of Patents and Trademarks*